US005526531A

United States Patent [19]

Olson et al.

[11] Patent Number: 5,526,531

[45] Date of Patent: Jun. 18, 1996

[54] WRIST GUARD

[75] Inventors: Scott B. Olson; Mark M. Moffa, both of Minneapolis, Minn.

[73] Assignee: O.S. Designs, Inc., Waconia, Minn.

[21] Appl. No.: 510,759

[22] Filed: Aug. 3, 1995

Related U.S. Application Data

[63] Continuation of Ser. No. 181,779, Jan. 18, 1994, abandoned.

[51] Int. Cl.[6] ..... A41D 13/08

[52] U.S. Cl. ..... 2/16; 2/161.1; 2/162; 602/21

[58] Field of Search ..... 2/16, 20, 21, 159, 2/160, 161.1, 161.5, 162, 910, 917; 473/59, 61, 62; 602/21, 22; 362/103, 109

[56] References Cited

U.S. PATENT DOCUMENTS

| | | | |
|---|---|---|---|
| Re. 32,566 | 12/1987 | Patton, Jr. | 473/62 |
| D. 288,372 | 2/1987 | Adams . | |
| 975,734 | 11/1910 | Tebeau | 2/20 |
| 1,369,810 | 3/1921 | Hinze | 2/20 |
| 1,377,103 | 5/1921 | Suhr | 2/16 |
| 2,025,710 | 2/1935 | Beemer . | |
| 2,388,330 | 11/1945 | Jungmann . | |
| 2,388,437 | 11/1945 | Ottmer | 2/20 |
| 2,391,851 | 12/1945 | Willard | 473/61 |
| 2,924,458 | 2/1960 | Barry | 2/16 |
| 3,117,786 | 1/1964 | Anderson . | |
| 3,423,095 | 1/1969 | Cox . | |
| 3,790,168 | 2/1974 | Hashimoto | 2/917 |
| 3,871,029 | 3/1975 | Hollman | 2/161.1 |
| 4,011,596 | 3/1977 | Chang . | |
| 4,047,250 | 9/1977 | Norman | 2/161.1 |
| 4,400,829 | 8/1983 | Willis . | |
| 4,438,532 | 3/1984 | Campanella et al. . | |
| 4,584,993 | 4/1986 | Nelson . | |
| 4,625,339 | 12/1986 | Peters | 2/160 |
| 4,881,533 | 11/1989 | Teurlings . | |
| 5,014,689 | 5/1991 | Meunchen et al. . | |
| 5,313,667 | 5/1994 | Levine | 2/160 |
| 5,339,465 | 8/1994 | Kyewski | 2/161.1 |
| 5,345,368 | 9/1994 | Huff | 2/160 |

OTHER PUBLICATIONS

The Paragon Catalog, E. Refletive Gloves, Fall 1993.

*Primary Examiner*—Michael A. Neas

*Attorney, Agent, or Firm*—Schwegman, Lundberg, Woessner & Kluth

[57] ABSTRACT

The present invention is a wrist guard which has a molded body having its first end configured to contact a user's palm and a second end configured to engage the user's forearm. A thumb receiving member is located at a first side of the palm end of the wrist guard and is designed to prevent overextension of the thumb. The forearm portion stabilizes the wrist guard so it does not rotate. The first strap extends betweens the thumb covering and the opposing side of the first end of the palm and of the stiff body member. This strap is selectively adjustable to ensure proper fit. A second strap is located at the forearm end of the wrist guard. This strap, like the first strap, is selectively adjustable to ensure proper fit. The user will insert their thumb into the thumb receiving member and tighten the straps for securing the wrist guard.

22 Claims, 4 Drawing Sheets

WRIST GUARD

This is a continuation of application Ser. No. 08/181,779, filed on Jan. 18, 1994 now abandoned.

I. FIELD OF THE INVENTION

The present invention relates to protective hand and wrist devices and more particularly to a device for protecting the hands and wrists of a person engaged in activities which may cause the person to break a fall with their hands such as when in-line skating.

II. BACKGROUND OF THE INVENTION

The popularity of activities such as in-line skating and skate boarding has increased the need for hand and wrist protective devices. When one falls in these activities, one tends to put one's hands out to break the fall. In doing so, one can easily break one's wrist or cause other serious injury. Therefore, the primary object of most of these devices is to provide a rigid support to prevent the user from breaking their wrist or other serious injury.

Some protective devices, like that shown in U.S. Pat. No. 4,011,596 to Chang, are cumbersome sleeve type arrangements which do not allow the user a full range of movement. Additionally, during the activity these sleeve type arrangements may become warm to the user. Another type of protective device has a design. similar to a glove without finger or thumb covers such as the wrist brace shown in U.S. Pat. No. 4,584,993 to Nelson. These protective devices include a narrow rectangular piece of a hard material which extends from the palm to the wrist. The narrow pieces of hard material may slip to the side, removing the protection to the user. Additionally, the thumb is not protected in many of these devices and cannot prevent the overextension of the user's thumb called Scaphoid Bowie. Furthermore, the glove type devices are unnecessarily confining because it wraps around the palm and hand and may become warm to the user. Some of the glove type devices may use a mesh type material to avoid heat build-up. However, the mesh material may still become uncomfortable, unnecessarily confining and not prevent thumb overextension.

Therefore, what is needed is an improved wrist guard which is light weight, not confining and maintains good support.

The primary object of the present invention is to provide an improved wrist guard which optimizes protection while minimizing bulk and weight.

Another object of the present invention is to provide an improved wrist guard which can incorporate safety features such as a light for night time use and reflective tape.

Yet another object of the present invention is to provide a wrist guard which prevents overextension of the thumb.

SUMMARY OF THE INVENTION

The wrist guard of the present invention includes a molded frame to be positioned on the inner portion of the user's forearm and a portion of the user's palm. The molded frame has a configuration which conforms to the user's forearm and palm with a narrow intermediate portion. The molded frame is secured to the user at the forearm end and the palm end.

The forearm end incorporates an adjustable arm encircling strap. The strap extends from one side of the molded forearm portion to a slot on the opposing side. The strap is inserted through the slot and wrapped around to fold the portion of the strap back over located between the one side and the slot. The strap contains hook and loop material to secure the strap and allow for an adjustable fit. The strap prevents rotation of the wrist guard.

A thumb receiving member which can encompass the entire thumb is connected to the palm portion. An adjustable strap extends from the thumb receiving member across the back portion of the hand to a slot at the side of the molded frame opposite the thumb. The strap extends through the slot and is secured by folding the strap over the strap portion between the thumb covering and the slot. The strap contains hook and loop material to provide adjustable and secure fit. The strap and thumb covering prevent overextension of the thumb.

This wrist guard allows the user more freedom of movement in the wrist and hand than current wrist guards. It also contains less restrictive material thus making it more comfortable while still protecting the wrist, palm and thumb areas. Furthermore, it can contain safety items such as reflective materials on the strap or a flashlight on the molded frame for night time use.

DESCRIPTION OF THE DRAWINGS

These and other features of the present invention will be understood in the detailed description of the preferred embodiment reflected in the accompanying drawings in which like numerals in the several views refer to corresponding parts.

DETAILED DESCRIPTION OF THE PREFERRED EMBODIMENT

Figure 1:
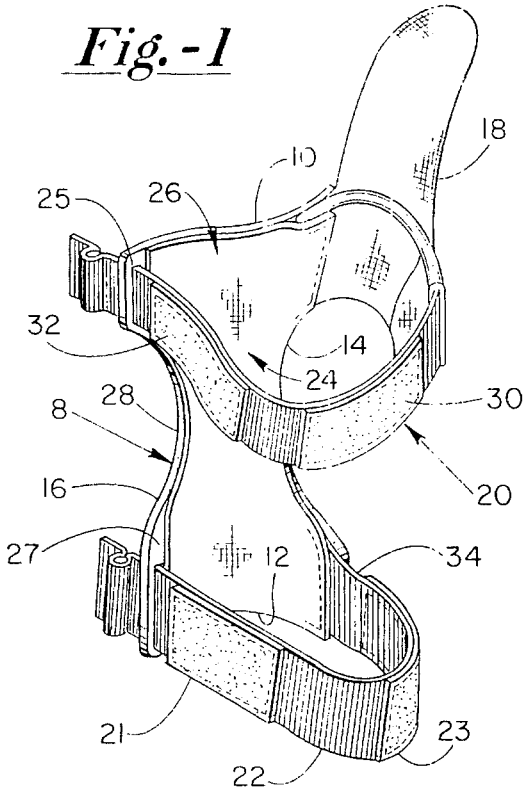
FIG. 1 is a perspective view of the present invention.

The wrist guard of the present invention is shown in FIG. 1. It contains a molded body 8 with a first end 10, a second end 12, a first side 14 and a second side 16. A thumb receiving member 18 is located along the first side 14 at the first end 10. The wrist guard also contains first and second selectively adjustable straps 20 and 22. The first strap 20 extends between the thumb covering 18 and the second side 16 of the first end 10. The second selectively adjustable strap 22 extends from the first side 14 to the second side 16 adjacent the second end 12 of the wrist guard.

Figure 2:
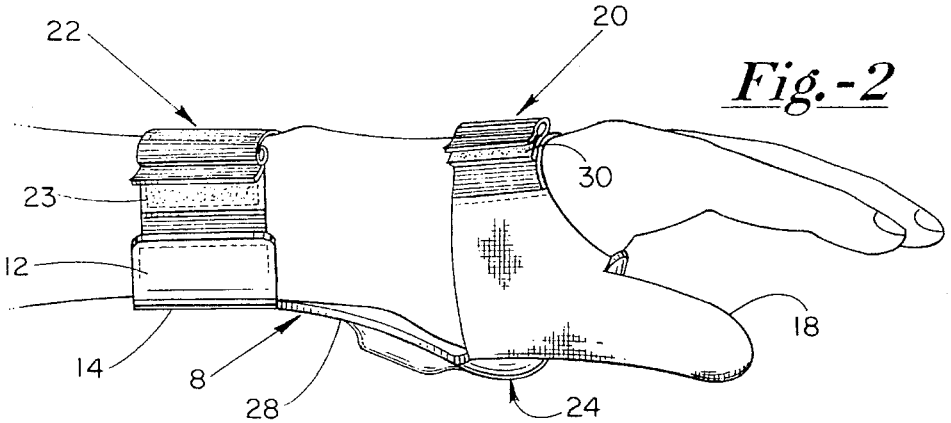
FIG. 2 is a side view of the present invention showing the thumb side.
Figure 3:
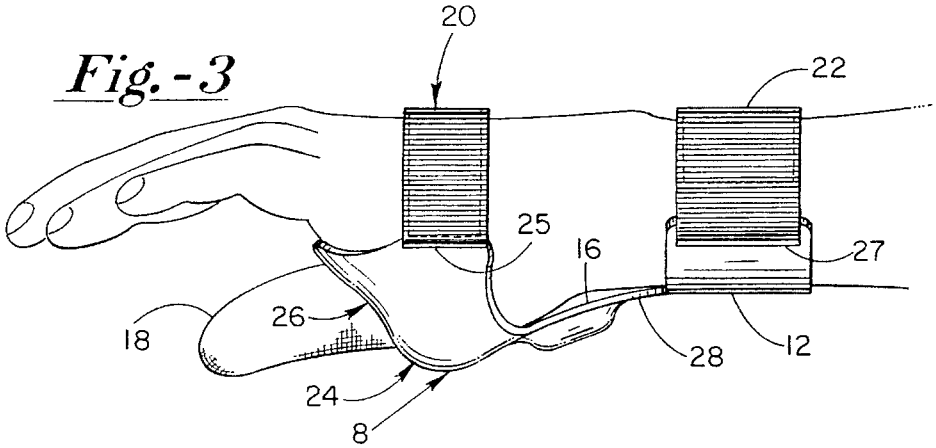
FIG. 3 is a side view of the present invention opposite the thumb side.
Figure 4:
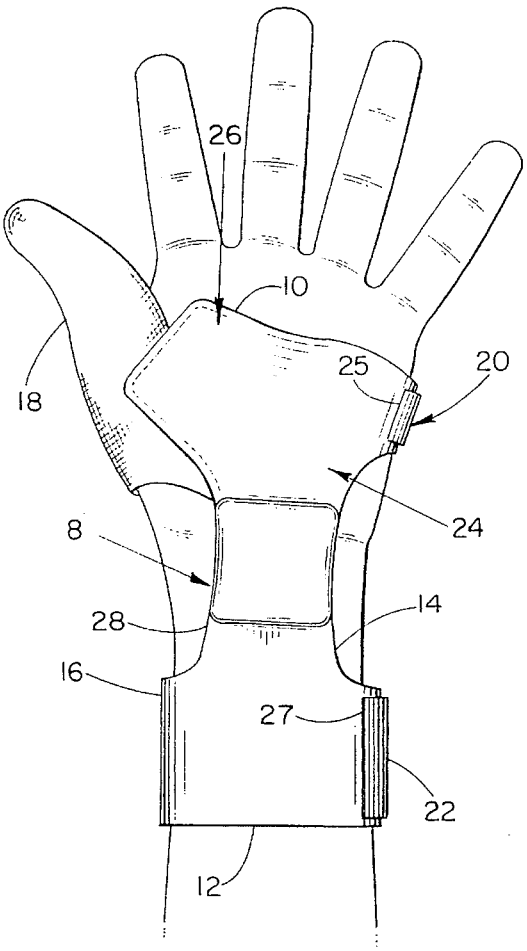
FIG. 4 is a bottom view of the present invention.
Figure 5:
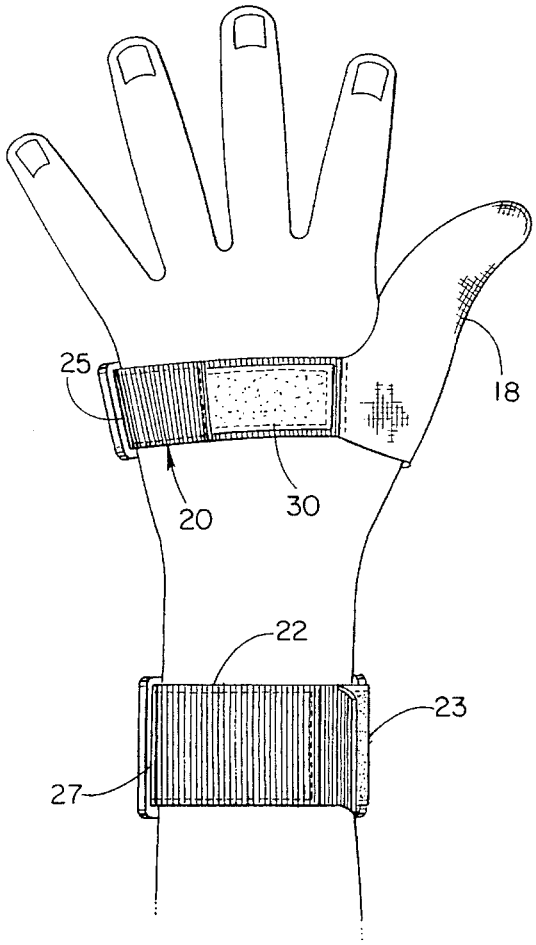
FIG. 5 is a top view of the present invention.
Figure 6:
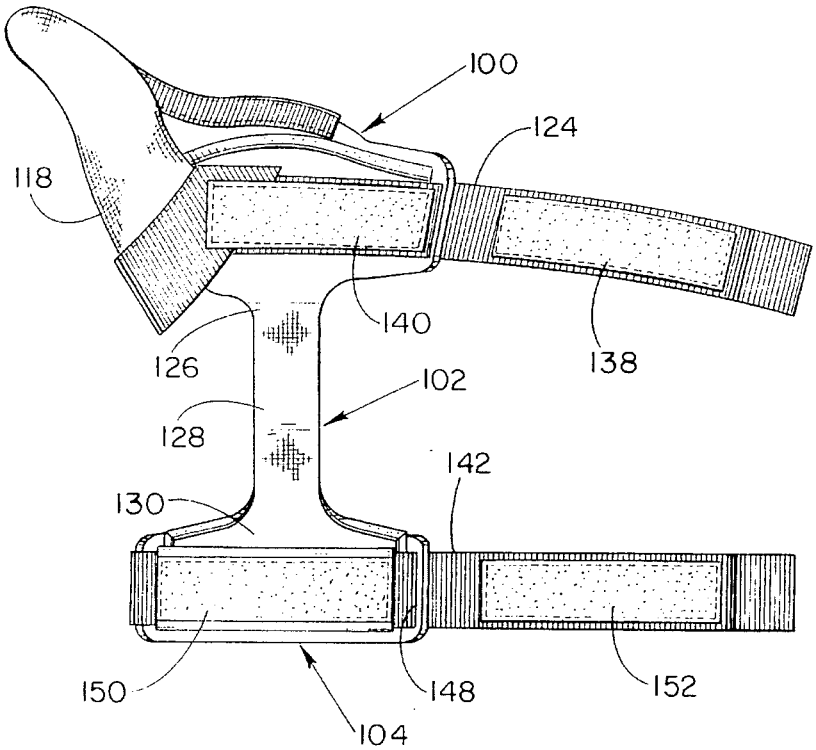
FIG. 6 is a top elevational view of a second embodiment of the present invention.
Figure 7:
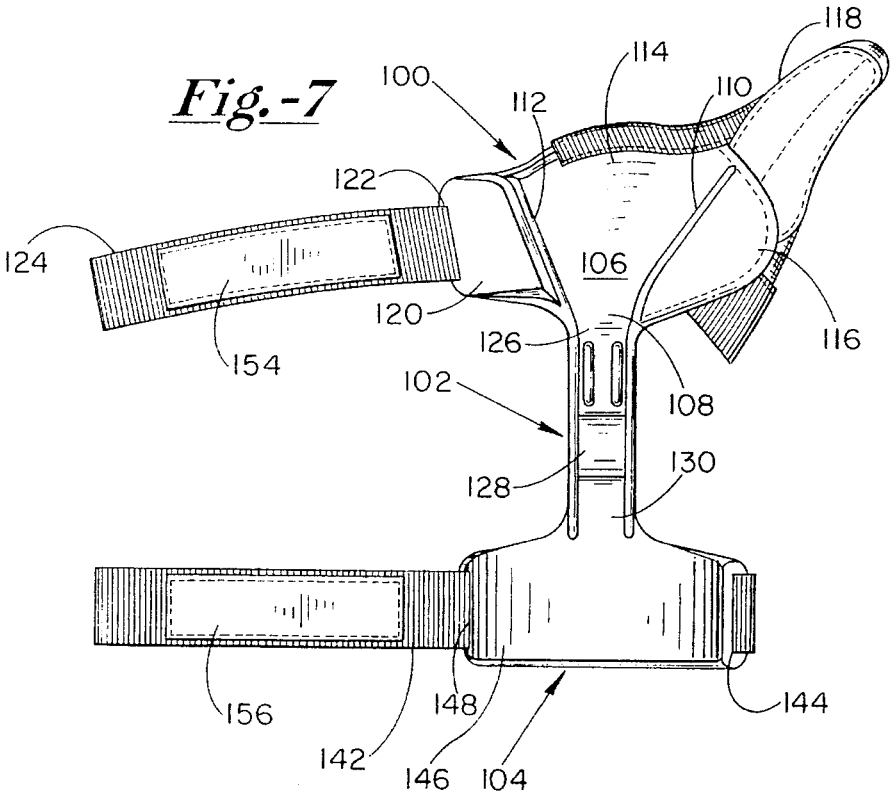
FIG. 7 is a bottom elevational view of the second embodiment of the present invention.

The configuration of the body member 8 can be seen in greater detail in FIGS. 2, 3, and 4. The first end 10 contacts the palm of the wearer. It has a general concave portion 24 and a convex portion 26 for conforming to the general shape of the user's lower palm area. The body 8 then narrows after the palm portion of the first end 10. Extending from the concave portion 24 of the palm configuration is a narrow intermediate area 28 or bridge for protecting the inner wrist. The bridge 28 does not contact the inner wrist. Instead it extends away from the user's wrist as seen in FIGS. 2 and 3. The bridge area 28 then angles so the wrist guard then contacts the forearm at the second end 12.

The second end 12 is configured to conform to the user's forearm adjacent the wrist as shown in FIGS. 1, 2, 3, 4 and 5. At the second end, the width of body 8 increases and forms a concave configuration to encircle a portion of the user's arm. This prevents the guard from rotating when the thumb protection mechanism is in action.

The body 8 itself is preferably made of a light weight material. In the preferred embodiment it is a molded polyethylene, but any comparable material which will provide the similar characteristics desired is acceptable. The body member 8 can also contain neoprene liner or similar liner for the user's comfort. The entire body need not be an integral molded part. For example, the forearm end and the second strap may simply be a wide strap instead of a wide, molded concave member and a strap.

The thumb receiving member 18 is located on the first side 14 at the palm end 10. The thumb receiving member 18 shown is designed to cover the entire thumb, however, the thumb receiving member need not cover the entire thumb. The thumb receiving member helps prevent the wrist guard from sliding off the palm area toward the forearm and prevents overextension of the thumb. It is made out of breathable materials such as cotton, leather or other breathable synthetic material.

The first strap 20 is joined to the thumb covering 18. Located on the second side 16 of the palm end 10 is a slot 25 for receiving the strap 20 therethrough. The strap 20 has conventional corresponding hook and loop material located on one side as shown by 30 and 32 for adjusting the strap to the proper size for fit. This first strap works with the protective thumb receiving member to prevent overextension of the thumb.

The second strap 22 may be wider than the first strap 20. The second strap 22 is connected to the first side 14 at the forearm end 12. A slot 27 for receiving the second strap 22 therethrough is located at the second side 16 at the wrist end 12. The second strap 22, like the first strap 20, contains corresponding conventional hook and loop material 21 and 23 on the same side. One selectively adjusts each strap for a proper fit by pulling on the strap through the respective slot and then folding the strap back over itself to engage the hook and loop material 21. The straps may consist of two portions which secure with a buckle, instead of a single strap.

The second embodiment of the present invention is shown in FIGS. 6–9. This embodiment has a palm portion 100, an intermediate portion 102 and a forearm portion 104. The overall configuration of this embodiment is smaller than the first embodiment but offers comparable protection.

The palm portion 100 has three areas. The central area 106 is narrow at the wrist end 108 and widens towards the palm end 114. Two angled walls 110 and 112 define the central area 106. The central portion 106 has a convex area 114 opposite the narrow end 108 to conform to the user's palm configuration. A thumb portion 116 extends along one end of the central area's angled wall 110. This portion 116 will support the thumb area of the palm and is slightly convex. The thumb covering 118 is stitched along the thumb portion 116 and the central portion 106 as shown in FIGS. 6–9. Along the other side of angled wall 112 of the central area 106 is a convex area 120 which contains a slot 122 for receiving the first strap 124 therethrough. It also has a convex configuration to conform to the user's hand. The angled walls 110 and 112 separating the central area from the convex area 120 and thumb portion 116 help strengthen the wrist guard and create a spring like quality to the member.

The intermediate portion 102 extends from the central area 106. It is narrower and has a configuration similar to the first embodiment. Intermediate portion 102 first angles away from the palm and wrist area as shown at 126. It then has a straight portion 128 and then angles back toward the forearm as shown at 130. The angled walls 110 and 112 of the palm portion extend down along the sides of the intermediate portion 102 for support.

The arm engaging portion 104, like that of the first embodiment, is concave so as to encircle a portion of the user's forearm. Arm engaging portion 104 prevents rotation of the guard when the thumb receiving member operates to prevent overextension of the thumb.

The straps of the second embodiment are similar to those of the first embodiment. The first strap 124 is stitched to the thumb receiving member 118 as shown in FIGS. 6–9. The opposing side 134 has a slot 122 for receiving the strap 124 therethrough. The strap has corresponding hook and loop material 138 and 140 for adjustability of the strap 124. Likewise a second strap 142 is stitched to the wrist guard on side 144. The opposing side 146 has a slot 148 for receiving the strap 142 therethrough. The strap 142 also has corresponding hook and loop material 150 and 152 for adjustability of the strap 142. Again, each strap may consist of two separate portions which secure with a buckle.

Figure 8:
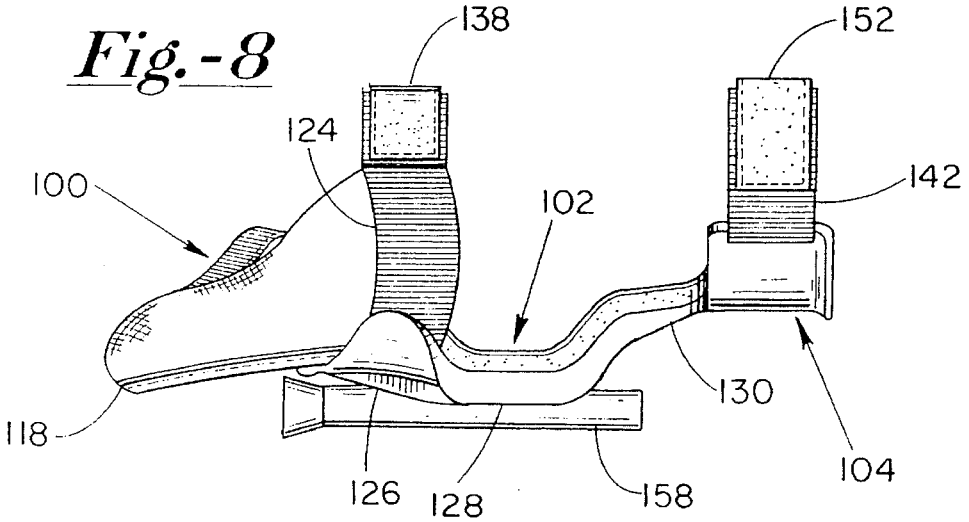
FIG. 8 is a side elevational view of the second embodiment of the present invention.
Figure 9:
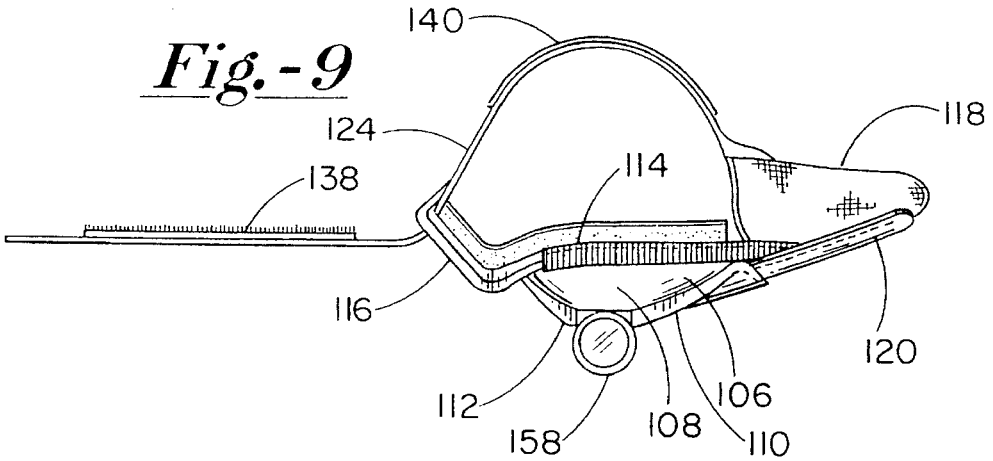
FIG. 9 is an end view of the second embodiment of the present invention.

This embodiment incorporates two safety features not shown with the first embodiment although they may be used with the first embodiment. First, reflective tape is located on the outside of the strap as shown at 154 and 156. Second, the channel created by the walls 110 and 112 extending along the length of the intermediate narrow portion 102 allows a small flashlight 158 to be held in this channel as illustrated in FIGS. 8 and 9 in broken line. There are various ways to attach the flashlight 158 to the wrist guard such as hook and loop material, a strap, a friction fit with walls 110 and 112 or being integrally molded with the wrist guard. Additionally, reflective material may be found on the body. This may be in the form of reflective tape, a reflective coating or other comparable reflective materials.

The wrist guard is used by inserting the user's thumb in the thumb receiving member 18 and then adjusting the first strap 20 and the second strap 22. The user secures the straps to a comfortable position. The wrist guard is now in the proper position and will prevent injury to the wrist, thumb and palm portion of the user.

In the second embodiment the user slips the thumb into the thumb receiving member 118 and inserts the forearm in the forearm portion 104. The straps 124 and 142 are tightened by pulling them through their respective slot and folding the strap back over the remaining portion of the strap to engage the hook and loop material. The reflective tape 154 and 156 is located on the exterior of the straps. Additionally, the flashlight 158 may be inserted and turned on for use at dusk or at night.

The wrist guard is ideally made in a variety of sizes to take into account the various hand sizes of users. It can be seen by the design of the present invention that the user has more maneuverability of his hand and wrist. Furthermore, the wrist guard maintains the necessary protection to the palm, thumb and wrist. Additionally, the wrist guard is not as bulky as previous wrist guards and will be more comfortable for the user.

While the above provides a full and complete disclosure of the preferred embodiment of the present invention, various modifications, alternative constructions and equivalents will occur to those skilled in the art given benefit of this disclosure, thus, the invention is not limited to the specific embodiments described herein, but is defined by the claims.

What is claimed:

1. A protective wrist guard comprising:

a. a body having a proximal end conforming to a portion of a user's forearm, a distal end conforming to a portion of a user's palm adjacent an inner wrist, an intermediate area bridging said proximal and distal ends, a first side, and a second side, said intermediate area having a portion spaced apart from said user's inner wrist;

b. a thumb receiving sleeve located at said first side adjacent said distal end;

c. a first selectively adjustable strap assembly extending between said thumb receiving sleeve and said second side adjacent said distal end; and d. a second selectively adjustable strap assembly extending between said first side and said second side adjacent said proximal end.

2. A protective wrist guard of claim 1 wherein said first selectively adjustable strap assembly and said second selectively adjustable strap assembly contain corresponding hook and loop material.

3. A protective wrist guard of claim 1 wherein said body is a light weight polyethylene material.

4. A protective wrist guard of claim 2 and further including a liner on said body.

5. A protective wrist guard of claim 1 and further including a light attached to said protective wrist guard.

6. A protective wrist guard of claim 1 and further including reflective material on said first selectively adjustable strap assembly and said second selectively adjustable strap assembly.

7. A protective wrist guard of claim 1 and further including reflective material on said body.

8. A protective wrist guard comprising:

a. a preformed body having a palm end conforming to a palm configuration, a forearm end configured to engage a forearm and an intermediate area spaced apart from an inner wrist area of a user, said preformed body having a first side and a second side;

b. a thumb receiving sleeve extending from said first side adjacent said palm end;

c. a first selectively adjustable strap assembly extending between said thumb receiving sleeve and said second side adjacent said palm end; and d. a second selectively adjustable strap assembly extending between said first side adjacent said forearm end and said second side adjacent said forearm end.

9. A protective wrist guard of claim 8 wherein said first selectively adjustable strap assembly and said second selectively adjustable strap assembly contain corresponding hook and loop material.

10. A protective wrist guard of claim 8 wherein said preformed body is a light weight polyethylene material.

11. A protective wrist guard of claim 8 and further including a liner on said preformed body.

12. A protective wrist guard of claim 8 and further including a light attached to said protective wrist guard.

13. A protective wrist guard of claim 8 and further including reflective material on said first selectively adjustable strap assembly and said second selectively adjustable strap assembly.

14. A protective wrist guard of claim 8 and further including reflective material on said preformed body.

15. A protective wrist guard comprising:

a. a body having a first end configured to conform to a user's palm, said first end having a convex area and a concave area, a second end configured to conform to a portion of a user's forearm, said second end having a concave surface and an intermediate portion spaced apart from a user's inner wrist;

b. a thumb receiving sleeve located at a first side adjacent said first end;

c. a first selectively adjustable strap connected to said thumb receiving sleeve;

d. a first strap receiving slot located on said first end opposite said first selectively adjustable strap;

e. a second selectively adjustable strap connected to said second end; and f. a second strap receiving slot located on said second end opposite said second selectively adjustable strap.

16. A protective wrist guard of claim 15 and further including a first wall and a second wall extending along said intermediate portion.

17. A protective wrist guard of claim 15 and further including a light attached to said protective wrist guard.

18. A protective wrist guard of claim 15 and further including reflective material on said first selectively adjustable strap and said second selectively adjustable strap.

19. A protective wrist guard of claim 15 wherein said first selectively adjustable strap and said second selectively adjustable strap contain corresponding hook and loop material.

20. A protective wrist guard of claim 15 wherein said body is a light weight polyethylene material.

21. A protective wrist guard of claim 15 and further including a liner on said body.

22. A protective wrist guard of claim 15 and further including reflective material on said body.

* * * * *

UNITED STATES PATENT AND TRADEMARK OFFICE

CERTIFICATE OF CORRECTION

PATENT NO. : 5,526,531

DATED : June 18, 1996

INVENTOR(S) : Scott B. Olson et al.

It is certified that error appears in the above-identified patent and that said Letters Patent is hereby corrected as shown below:

Item [56],
Cover page, under Other Publications, delete "Refletive" and insert therefor --Reflective--.

Signed and Sealed this

Fourteenth Day of January, 1997

*Attest:*

*Attesting Officer*

BRUCE LEHMAN

*Commissioner of Patents and Trademarks*